United States Patent [19]

Shuman

[11] Patent Number: 4,776,116

[45] Date of Patent: Oct. 11, 1988

[54] ROTATIONAL SIGNHOLDER SUPPORT ASSEMBLY

[75] Inventor: Bernard Shuman, Merrick, N.Y.

[73] Assignee: EEE Corporation, Port Washington, N.Y.

[21] Appl. No.: 90,219

[22] Filed: Aug. 27, 1987

[51] Int. Cl.[4] ..... G09F 3/18

[52] U.S. Cl. ..... 40/642; 40/607; 40/606; 40/612

[58] Field of Search ..... 40/10, 606, 607, 493, 40/124, 612

[56] References Cited

U.S. PATENT DOCUMENTS

| | | | |
|---|---|---|---|
| 1,335,870 | 4/1920 | Andersen | 40/607 |
| 1,483,622 | 2/1924 | Voorhees | 40/607 |
| 1,529,752 | 3/1925 | Sprung | 40/607 |
| 1,537,523 | 5/1925 | Boland | 40/607 |
| 3,296,725 | 1/1967 | Fenwick | 40/606 |
| 3,908,947 | 9/1975 | Bledsoe | 40/606 |
| 4,197,806 | 4/1980 | Kinniger | 40/612 |
| 4,574,507 | 3/1986 | Elliot | 40/607 |

*Primary Examiner*—Gene Mancene

*Assistant Examiner*—Wenceslao J. Contreras

*Attorney, Agent, or Firm*—Henry Sternberg; Bert J. Lewen

[57] ABSTRACT

Rotational signholder support assembly formed of a male adapter and mating female socket rotatably receiving the adapter in a selective number of individual relative angular rotational alignment positions, the adapter including an annular rim having a number of circumferentially spaced apart stops corresponding to the number and alignment of such positions, and a shank having a bore for receiving a mating male insert adapted for connection to an overlying signholder, and further having a circular exterior wall, and the socket including an annular recess receiving the rim and having arresters of number and alignment corresponding to the stops and releasably interlockable therewith at each such position, and a circular orifice receiving the circular wall, such that when the adapter is in the socket at the selected position, each stop interlocks with the adjacent arrester to maintain the adapter at that position, and when the adapter is rotated to a different position the stops unlock from the original arresters and reinterlock with those at the different position.

14 Claims, 2 Drawing Sheets

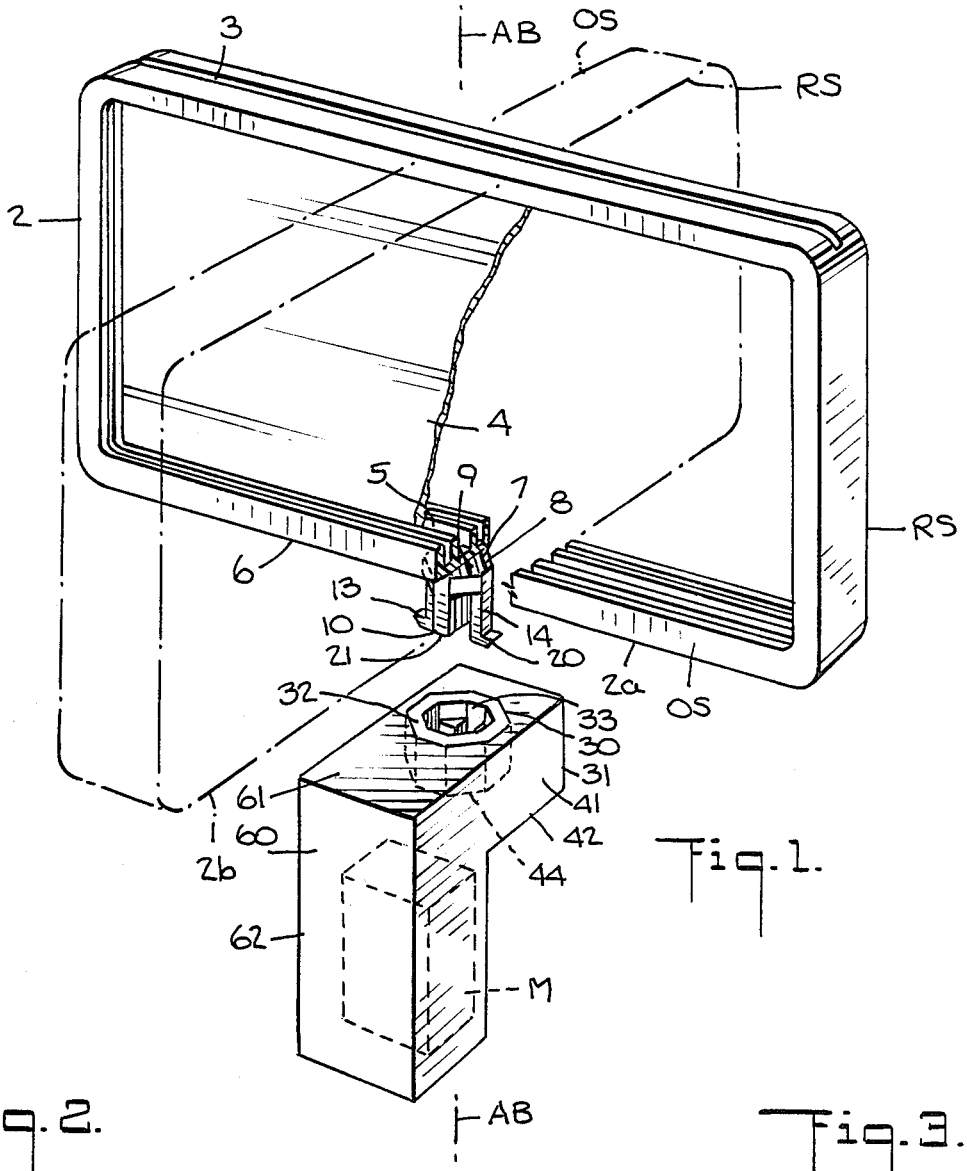
Fig. 1.
Fig. 2.
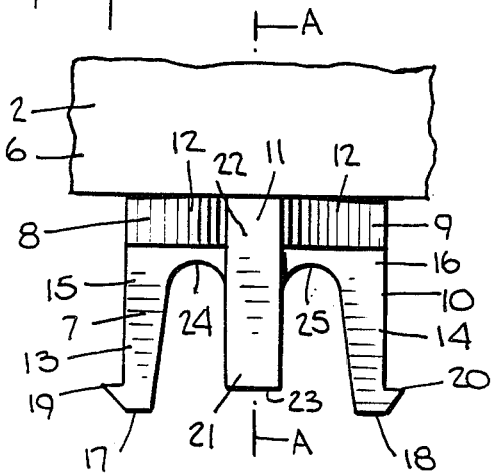
Fig. 3.
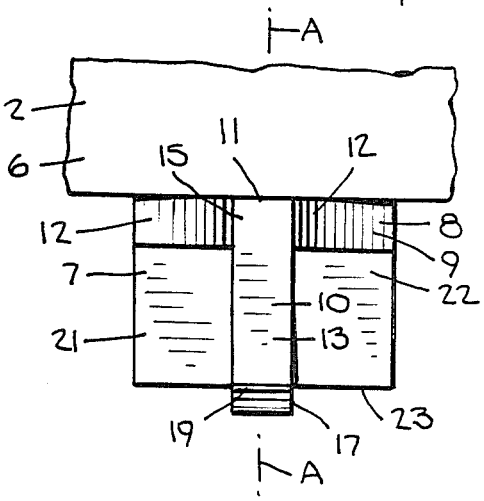

ROTATIONAL SIGNHOLDER SUPPORT ASSEMBLY

FIELD AND BACKGROUND OF THE INVENTION

The present invention relates to a rotational signholder support assembly, and more particularly to a male adapter rotatable in a mating female socket between a number of different individual alignment positions, the adapter being used to carry an insert connected to an overlying signholder frame, so that by rotating the adapter in the socket the signholder frame may be located in a corresponding number of changeable alignment positions.

Signholder assemblies are known which are usable as merchandising aids to display indicia on cards, panels and the like type signs, and often include a signholder frame in which such an indicia containing sign is inserted, permitting the frame to be mounted in a convenient location of a consumer shopping area such as a retail store. The frame usually includes a male insert arrangement, which is interchangeably inserted in and fixedly seated against a stationary female mounting socket arrangement, attached to or forming a part of a stationary support.

A major drawback of such known signholder assemblies is that the insert and socket arrangements are usually provided with alternative fixed angular position interconnecting formations, for example counterpart square or cruciform shape formations, such that if it is desired to change the individual relative angular rotational alignment position of the insert arrangement in the socket arrangement for thereby changing the signholder frame angular orientation, the insert arrangement with its signholder frame must be removed from the socket arrangement, rotated to a different angular rotational alignment position, e.g. 90 or 180 degrees from the original position, and reinserted in the socket arrangement.

Also, once the insert arrangement is in a given fixed angular position in the socket arrangement, any external rotational forces acting on the signholder frame, such as those which might occur upon unintentional or otherwise manual grapsing or twisting of the sign, are transmitted more or less directly via the insert arrangement to the socket arrangement. This construction renders the often relatively delicate, normally plastic, interconnecting formation components of the assembly vulnerable to fracture, and especially to the complete breaking off of the exposed upper portion of the insert arrangement, which is connected to the signholder frame, from the lower portion thereof, which is fixedly seated in the stationary socket arrangement, under the resultant twisting force transmitted thereto by the frame acting as a first class lever, and whose thrust is concentrated at the point of connection between the upper exposed and lower seated portions of the insert arrangement.

It would be desirable to provide a signholder support assembly of the contemplated general type, constructed so as to permit changing of the angular rotational alignment position of such a signholder frame without having to remove the insert arrangement, to which it is attached, from its inserted position in the mating socket arrangement, and at the same time overcome any adverse effects of extraneous forces acting on any connection portions of the adjacent parts of the assembly.

SUMMARY OF THE INVENTION

It is among the objects and advantages of the present invention to overcome the drawbacks and deficiencies of the prior art, and to provide a rotational signholder support assembly, which includes a male adapter received in a stationary mating female socket and rotatable therein between a number of different changeable individual relative angular rotational alignment positions, the adapter being used to carry an insert connected to an overlying signholder frame, so that by rotating the adapter in the socket the signholder frame may be located in a corresponding number of changeable alignment positions without having to remove the adapter from the socket, or the insert and frame from the adapter.

It is among the additional objects and advantages of the present invention to provide an assembly of the foregoing type, which is constructed in such a manner that all external rotational, or twisting and shearing, forces acting on any signholder frame and/or insert present in the assembly, and transmitted to the adapter, will merely cause rotation of the adapter in the socket, and thus avoid the otherwise adverse effects of such twisting and shearing forces on the interconnected parts.

It is among the further objects and advantages of the present invention to provide an assembly of the stated type, which is comparatively simple in design, inexpensive in construction, as well as robust and long wearing in use, and which can be made from commercially available materials in accordance with common manufacturing methods.

According to the present invention, a rotational signholder support assembly is advantageously provided, which comprises a rotatable male tubular adapter and a stationary mating female mounting socket for rotatably coaxially receiving the adapter in a selective number of rotatably changeable individual relative angular rotational alignment positions.

The adapter includes an annular rim having stop means, such as a number of circumferentially spaced apart stops corresponding to the number and angular rotational alignment of said positions, and a shank connected to the rim and having an interior bore, adapted for receiving a mating male attachment insert which in turn is adapted for connection thereto of an overlying signholder, and further having a circular exterior wall.

The socket includes an annular recess arranged for receiving the rim and having arrester means, such as counterpart circumferentially spaced apart arresters of number and angular rotational alignment corresponding to the stops and individually respectively releasably interlockable with the stops at each said position, and a circular interior orifice communicating with the recess and arranged for receiving the adapter circular exterior wall.

The stop means and arrester means are arranged such that when the adapter is in the socket at a selected said position, the stop means releasably operatively interlock with the arrester means to maintain the adapter releasably at that position, and when the adapter is rotated to a different position the stop means operatively unlock from the arrester means and operatively reinterlock with the arrester means at the different position.

More specifically, the stop means may include a number of circumferentially equally spaced apart stops, e.g. in the form of resiliently deformable radial projections, corresponding to the number and angular rotational alignment of said positions, and the arrester means may include counterpart circumferentially equally spaced apart arresters, e.g. in the form of radial depressions, of number and angular rotational alignment corresponding to the stops and individually respectively releasably interlockable with the stops at each said position, i.e. with the depressions releasably receiving and retaining the projections.

Thus, when the adapter is in the socket at a selected said position, each stop releasably interlocks with the adjacent arrester in rotational alignment therewith to maintain the adapter releasably at that position, and when the adapter is rotated to a different position the stops unlock from the original arresters and reinterlock with those at the different position.

Preferably, the adapter circular wall contains an edge formation, such as a resilient detent, and the socket circular orifice contains a counterpart abutment, such as a detent engaging lip, releasably interengageable with the edge formation to maintain the adapter in rotatable interconnection with the socket when received therein.

The shank bore may have a connection formation for receiving a mating connection formation of a male attachment insert, the insert being adapted for connection thereto of an overlying signholder, such as by way of an integral connection between the insert and signholder, or an attachment clip interconnecting these two parts, or the like.

The socket may be non-rotatably connected to a stationary support, either integrally therewith, or alternatively by providing the socket in the form of a plug insertable in a hollow formation of such a support.

BRIEF DESCRIPTION OF THE DRAWINGS

Other and further objects and advantages of the present invention will become apparent from the within specification and accompanying drawings, in which:

FIG. 1 is a schematic perspective exploded view of a signholder support assembly, showing a male insert integrally connected to an overlying signholder frame, and a stationary support in the form of an angle bracket containing a rotatable male tubular adapter and a mating female mounting socket, here shown as a plug socket disposed in a hollow formation of the support, according to an embodiment of the present invention;

FIGS. 2, 3 and 4 are top, side and sectional views, respectively, of the adapter, having a cruciform interior bore, the view in FIG. 4 being a section taken along the line 4—4 of FIG. 2;

DESCRIPTION OF THE PREFERRED EMBODIMENTS

Figure 4:
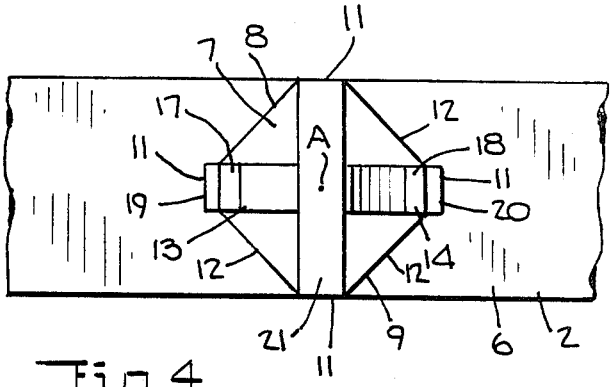

Referring to the drawings, and initially to FIG. 1, a rotational signholder support assembly 1 is shown, according to an embodiment of the present invention, including a vertical or upright signholder frame 2, e.g. made of plastic, having an entrance slit 3 for inserting a sign 4, containing merchandising indicia or the like, to be held in the usual manner by an inside bottom blind groove 5 in frame 2. Frame 2 is integrally connected at its underside portion 6 to a vertical male attachment insert 10, e.g. made of plastic.

Insert 10 is removably fixedly insertable in a vertical rotatable male tubular adapter 20, e.g. made of plastic, which in turn is rotatably insertable in a vertical female mounting socket 30, e.g. made of plastic, stationarily located in a support 40, which may be made of plastic, metal or the like, such that insert 10, adapter 20 and socket 30 are coaxially arranged relative to their corresponding central generally vertical axes A, B and C, as the case may be, shown in FIG. 1 as the common axis ABC.

Support 40 may be provided with an outer side wall 41 and a bottom peripheral edge 42, so as to define a generally internally hollow member having an open underside and non-rotatably receiving socket 30 in its upper side.

Adapter 20 is coaxially rotatably received in socket 30 in a selective number of rotatably changeable individual relative angular rotational alignment positions or sub-positions, e.g. eight such positions, so that upon rotation in either direction of adapter 20 from one position in socket 30 to the next position, frame 2 will be likewise rotated to change its angular alignment relative to axis ABC, since frame 2 is fixedly connected to insert 10, which is in turn mounted in adapter 20 for common rotation therewith. In this way, any sign carried in frame 2 may be conveniently changed in position, depending on the merchandising orientation, position and purpose of assembly 1.

FIGS. 2–4 show adapter 20 as a cruciform formation adapter, having the vertical rotational axis A, and which includes a peripheral annular rim 21 having stop means, including a number of circumferentially spaced apart stops 22, such as in the form of circumferentially equally spaced apart resiliently deformable radial projections, the number of stops 22 corresponding to the number and angular rotational alignment of the desired changeable positions, for example eight.

Adapter 20 further includes a shank 23, which is connected to rim 21, and which has an interior bore 24, provided with a connection formation in the form of internal cruciform slot formation 26, located below an entrance recess 28 and formed of the two right angle cross slots **29*a*,29*b*, for connection thereto of insert 10. Cross slots 29*a*,29*b* are in open communication centrally with each other and outwardly bounded by the circular, e.g. cylindrical, exterior wall 25 of shank 23. Exterior wall 25 preferably contains an edge formation, such as in the form of a resiliently deformable, e.g. peripheral annular, detent 27, spaced slightly above the underside 29*c* of adapter 20 (FIG. 3**).

Figure 5:
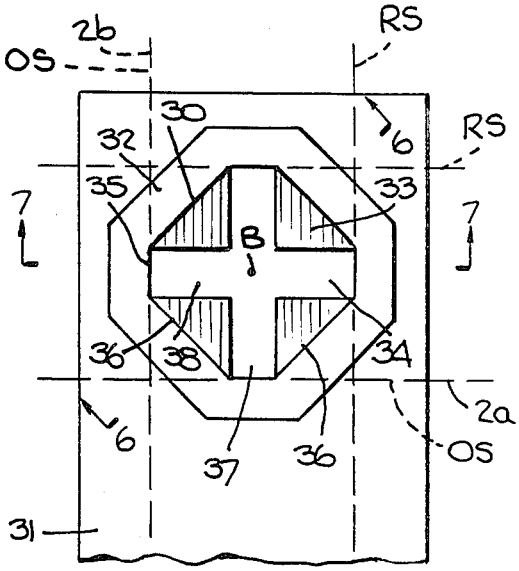
FIGS. 5 and 6 are top and sectional side views, respectively, of the socket, the view in FIG. 6 being a section taken along the line 6—6 of FIG. 5.
Figure 6:
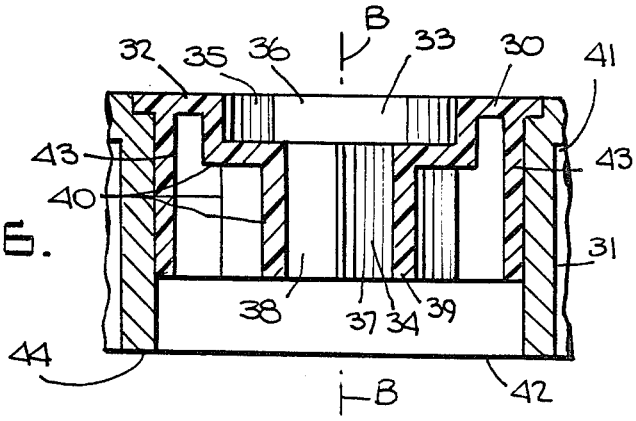

FIGS. 5–6 show socket 30 as a plug socket such as a tubular plug, non-rotatably inserted in a mating tubular hollow formation 43 of support 40, such support being of the type which may be located coveniently in a retail shopping area. Socket 30 has the vertical axis B, and includes a peripheral annular recess 31, arranged for rotatably receiving adapter rim 21, and having arrester means, including counterpart circumferentially spaced apart arresters 32, of number and angular rotational alignment corresponding to stops 22, for example eight, and individually respectively releasably interlockable with the stops 22 at each such position, such as in the form of circumferentially equally spaced apart radial depressions for releasably receiving and retaining the projection form adapter stops 22.

Socket 30 also includes a circular interior orifice 33 communicating with recess 31 and arranged in depending tubular portion 34, e.g. in the form of a downwardly and inwardly tapered orifice, for rotatably receiving adapter circular exterior wall 25. Tubular portion 34 is exteriorly bounded by outer side wall 35 of any suitable shape and a corresponding transverse bottom wall 36.

Preferably, orifice 33 inwardly and downwardly terminates at a counterpart abutment or shoulder on the adjacent margins of bottom wall 36, for releasably interengaging the adapter edge formation, such as in the form of a peripheral annular detent engaging lip 37 (FIG. 6) for engaging adapter detent 27 (FIG. 3), to maintain adapter 20 in rotatable interconnection with socket 30, especially where orifice 33 is tapered, while preventing undesired axial separation of adapter 20 from socket 30 due to the preferred presence of the coacting adapter detent 27 and socket lip 37.

Of course, any other plug form of the socket may be provided for removable insertion in a corresponding mating type reception formation on the particular support, and alternatively the socket may be integrally connected to the pertinent support.

As FIG. 1 shows, cruciform insert 10 is integral with frame 2 at its underside portion 6, has the vertical axis C, and includes a base portion or multi-sided plate 11, from which a cruciform lock formation 12 depends in cantilever fashion, including a pair of, e.g. horizontally deflecting, resilient fingers 13,13, each containing a catch 14,14 at the lower end thereof, plus a stabilizer crosswall 15, for conjoint mating with the cross slots *29a,29b* of the cruciform slot formation 26 in adapter bore 24.

More specifically, plate 11 is shaped and sized for mating with adapter entrance recess 28, and cruciform shaped connection formation 12 which depends from plate 11, includes the pair of opposed spaced apart cantilever resilient catch fingers 13,13, correspondingly containing resilient catches 14,14 at their lower free ends, forming one section of the right angle cross arrangement, and the intervening cantilever stabilizer cross wall 15 passing perpendicularly between the fingers 13,13 and also having a free end, the cross wall 15 forming the other section of the right angle cross arrangement.

The pair of fingers 13,13, and the cross wall 15 of cruciform formation 12 are sized and shaped for mating insertion into cross slots *29a,29b* of cruciform formation 26. Thus, cruciform formations 26 and 12 are sized for coactive interengagement, such that finger catches 14,14 will releasably lockingly engage the underside of shank 23 at the adjacent portion of the edge formation at the opposed outer ends of the appropriate slot *29a* or *29b*, e.g. containing detent 27.

Figure 7:
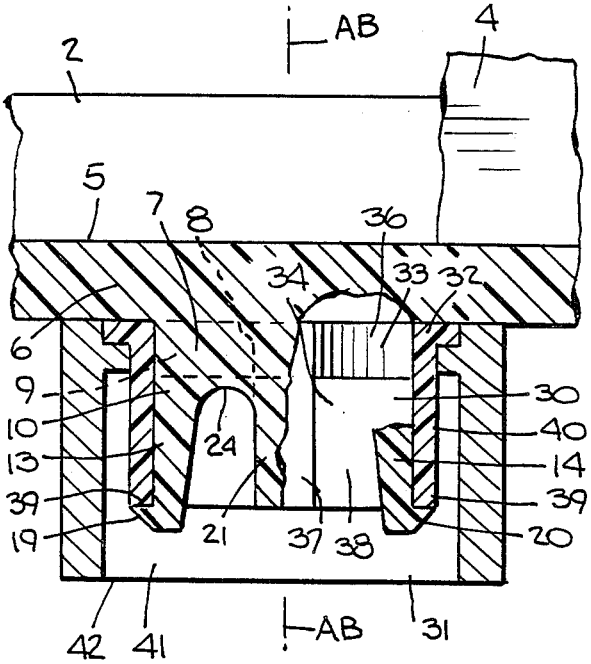
FIG. 7 is a sectional view showing the insert and a portion of the frame integrally connected thereto, positioned in the adapter of FIGS. 2–4, and in turn such adapter positioned in the socket of FIGS. 5 and 6, thereby representing pertinent parts of the overall assembly as shown in FIG. 1 in interconnected relation to each other.

FIG. 7 shows assembly 1 with the pertinent parts in interconnected coaxial condition, relative to the common axis ABC, including frame 2 integrally connected to insert 10, insert 10 inserted fixedly, i.e. non-rotatably, in adapter 20, such that cruciform lock formation 12 is held in adapter cruciform slot formation 26, via catches 14,14 locking against adapter underside *29c*, and adapter 20 rotatably inserted in socket 30, such that adapter detent 27 is rotatably seated against socket lip 37 and prevents adapter 20 from axially outwardly separating from socket 30. Socket 30 of course is non-rotatably mounted in stationary support 40.

It will be noted from FIG. 7 that because of the preferably tapered shape of socket orifice 33 and the round or cylindrical shape of adapter circular wall 25, such parts may be conveniently sized for mating coaction so as to limit axial and rotational contact therebetween to rim 21 and recess 31, on the one hand, and to detent 27 and lip 37, on the other hand, as the case may be.

Specifically, this will facilitate axial insertion of adapter 20 into socket 30 under minimum local deformation of detent 27 against the surrounding surface of tapered orifice 33, and only at the innermost portion of orifice 33 just as detent 27 reaches the point of releasable interlocking engagement with lip 37 on bottom wall 36. Once engaged, rim 21 will ride in recess 31 and detent 27 will ride against lip 37 during rotation of adapter 20 in socket 30 to change the desired rotational position therebetween, i.e. for changing the corresponding position of frame 2.

Advantageously, by providing socket orifice 33 with a tapered shape and adapter circular exterior wall 25 with a straight or cylindrical shape, the intermediate axial portions of these two parts will be spaced radially from each other, thereby minimizing friction therebeween when the adapter is rotated from one position to another. Hence, detent 27 and lip 37 are preferably provided as mating annular surfaces for engaging each other rotatably during such rotation.

Of course, formations 26 and 12 should be sized and shaped so as not to interfere with the desired releasable interlocking engagement of detent 27 with lip 37 on bottom wall 36 of socket 30 (FIG. 7).

By providing support 40 as an internally hollow member confined by a peripheral edge 42 forming an open underside (cf. FIGS. 1 and 7), access to locked fingers 13,13 is conveniently provided via such open underside for the purpose of releasing resilient catches 14,14 from engagement with the underside of shank 25, either manually or with a simple probe like tool, to remove insert 10 from adapter 20 in the usual manner.

Although insert 10 may be alternatively coaxially inserted in adapter 20 in different interchangeable relative angular rotational positions, at right angles to each other, due to the cruciform orientation of the various coacting parts of formations 12 and 20, such is of only minor significance according to the present invention. This is because the major significance of the multiple position relative rotatable coaction between adapter 20 and socket 30 is to permit rotation of signholder 2 by reason of that rotatable connection, regardless of whether or not insert 10 may be removably rotatably positioned in adapter 20.

In particular, as may be appreciated from FIG. 1, when adapter 20 is received in socket 30 at a selected relative angular rotational position, each stop 22 is releasably interlocked with the circumferentially adjacent arrester 32 in rotational alignment therewith to maintain adapter 20 releasably at that position. Thus, when adapter 20 is rotated to a different position, stops 22 unlock from the original arresters 32 and reinterlock with those at the different position, upon completing a number of "clicks" corresponding to the number of intervening stop and arrester engagement positions along the rotational distance between the original and new positions.

Where eight positions, for example, are involved, such that adapter 20 has eight stops 22 and socket has eight arresters 32, as adapter 20 is rotated it will rotate insert 10 simultaneously therewith so as to change the angular attitude or orientation of frame 2 from one to the next of eight corresponding positions.

Of course, it will be understood that any number of positions may be selected, by merely selecting the number of stops 22 and counterpart arresters 32 distributed about the circumference of the assembly. While the stops and arresters need not necessarily be equally circumferentially spaced apart, in which case the changeable positions will not be of uniform angular increment apart, it is understandably preferred that the stops and arresters be equidistantly spaced apart for providing uniform angular increments between the positions.

Heretofore, as earlier noted, corresponding known signholder support assemblies of the type contemplating a male insert and female socket, utilized a construction of the insert lock formation in which any downwardly extending appendages such as cantilever catch fingers, with or without any stabilizer cross walls, were directly connected to the upper base portion of the insert, in conjunction with a mating socket in which the slots of the slot formation extended upwardly to the upper platform portion, whereby to provide a non-rotatable interconnection between the insert fixedly carrying the signholder and the socket stationarily mounted on a support.

Hence, in such known type assembly, any twisting forces encountered by the insert, e.g. via the frame, were transmitted directly by the upper base portion to the point of connection thereto of the upper ends of the catch fingers and of any included cross wall, and in turn were transmitted by such upper ends of the catch fingers and of any such cross wall to the rigidly embracing upper end portions of the socket slots. This construction rendered these cantilever appendages, especially the fingers, vulnerable to shearing off at their cantilever connection points to the upper base portion, and constituted a distinct drawback of such known construction.

In contrast thereto, by way of the present invention, provision is made for a rotational connection between an adapter for receiving the insert and a socket for receiving the adapter, which avoids completely any stress on the parts of the contemplated insert connection formation, whether in the form of preferably plastic, generally fragile, springy cantilever appendages such as a pair of catch fingers and optional stabilizer cross wall, or in any other form such as a threaded, polygonal or other connection formation.

Specifically, by interposing the adapter between the insert and socket, and designing these parts for incremental rotation from one relative angular rotational alignment position to another, any twisting forces acting on the signholder frame will at worst cause mere rotation of the frame, insert and adapter as one composite unit in the stationary socket on the support as the other composite unit, without fear of damage or other adverse effect from such twisting action, while preserving the underlying merchandising function of the assembly, i.e. its accommodation of a signholder frame in more than one interchangeable relative angular rotational position for display purposes, without the need to separate any of the component parts.

The construction of the present invention lends itself to fashioning of the socket as a plug socket, and/or the support as an angle bracket, e.g. equipped with an internal magnet, for positioning at a horizontal corner of a merchandising case or the like, and not merely as a flat stationary support.

Thus, as shown in FIG. 1, socket 30 is conveniently provided as a plug socket in socket support 40 constructed as an angle bracket 60 having an upper horizontal arm 61 and a depending vertical arm 62, e.g. provided with a magnet M, as shown in phantom. This enables the user to position bracket 60 against a magnetic metal horizontal corner portion of a merchandising display case or similar primary stationary support.

As to frame 2, such may be provided as a simple transparent plastic flat rectangular double walled panel separated by an internal slit 3 terminating in a bottom blind groove 5 for holding a sign 4 containing indicia visible through each of the walls of the panel frame 2, i.e. on both the obverse side OS and reverse side RS thereof:

It is clear from FIG. 1 that frame 2 may be incrementally rotated from one of eight sub-positions to the next about the common axis ABC, since the adapter stops 22 and corresponding socket arresters 32 are arranged at eight equally circumferentially spaced apart points about axis ABC. For instance, by manually grasping frame 2, insert 10 and adapter 20 may be rotated 90 degrees relative to stationary socket 30 on bracket 60, through "click" intervals from sub-position **2*a* to sub-position 2*b*** (shown in phantom), or placed at any of the 45 degree "click" interval angular rotational positions provided, so as to bring either obverse side OS or reverse side RS into view as desired.

As the artisan will appreciate, according to the present invention, the adapter stop means and arrester stop means, such as the adapter stops and socket arresters, may take any convenient form, so long as they serve to interlock at a given relative angular rotational position, yet permit unlocking by simple manual twisting of the adapter, directly or via the insert and/or frame, to "click" the adapter rotatably in the socket to a different said position. Alternatively, the steps and arresters may be operatively transposed such that arrester projections are formed in the socket recess and stop depressions are formed on the adapter rim for coaction therewith in the contemplated manner.

It will be further realized that, by suitable conformation of the adapter rim and exterior wall relative to the coacting mating conformation of the socket recess and orifice, the adapter may be effectively rotatably maintained in the socket without the need for an edge formation, such as a detent, on the adapter exterior wall, and a counterpart abutment, such as a detent engaging lip, on the circular orifice.

More specifically, such conformations may be readily fashioned to provide proper axial alignment of the adapter in the socket at the desired level of the adapter top surface region relative to the socket top surface region, permitting the dead weight alone of the signholder frame and insert, acting downwardly on the adapter, to keep the adapter in the socket.

Alternatively, the stops and arresters may be in the form of corresponding short radial arms or bosses, and mating radial bores or shallow dents, permitting desird "click" interval rotation of the adapter in the socket, yet preventing axial separation of the parts.

The stops or the arresters, and favorably both, should be made of resilient material, preferably resiliently deformable material, to facilitate their unlocking and relocking at each given rotational "click" position. However, by precisely sizing these mating parts to have comparatively small dimensions within desirably close tolerances, so that minimum distortion is involved in disengaging the stops and arresters, rotating the adapter in the socket and reengaging the stops and arresters, the need for particularly resilient, or deformable, material is minimized.

As will also be appreciated, where the adapter exterior wall edge formation and socket orifice abutment are present, such as the adapter detent and socket lip, these may also take any convenient form, so long as they serve to interlock the adapter releasably in the socket against undesired axial separation while simultaneously permitting unhindered incremental interval "click" type rotation of the adapter in the socket. Of course, such arrangement should enable the adapter to unlock from the socket for separation therefrom, should this be desired, for instance by applying an axial separating force manually to the parts.

As to the adapter exterior wall edge formation and socket orifice abutment in general, here also one or both of these parts, e.g. the detent and/or lip, should be made of resilient material, preferably resiliently deformable material, to facilitate their unlocking and relocking, yet by precisely sizing these mating parts to have comparatively small dimensions within favorably close tolerances, so that minimum distortion is involved in engaging and disengaging them, the need for particularly resilient, or deformable, material is minimized.

Furthermore, according to the present invention, the adapter may be provided with any desired form of connection formation for non-rotatably attaching thereto a correspondingly provided mating connection formation on the contemplated insert, and is not to be limited to the type of connection formation specifically shown in the drawings, as such is set forth as a mere exemplification of the present invention. In particular, as to the adapter cruciform connecton formation, any other type of slot formation may be provided for attaching thereto any desired cantilever appendage containing cruciform connection formation on the contemplated insert. Alternatively, the adapter bore connection formation may be a threaded formation, polygonal formation, or the like, for reception of a mating insert threaded, polygonal or the like, counterpart connection formation.

It will be understood that the socket of the assembly may be connected non-rotatably to an angle bracket type support as shown in FIG. 1 or any other type stationary support, either as an integral part of the support or in the form of a plug socket thereon.

The frame, insert, adapter and socket, as well as the support for the socket, may each be made of plastic such as acrylonitrile-butadiene-styrene copolymer plastic (ABS), high impact polystyrene plastic (HIPS), and the like type materials. Alternatively, some of the parts such as the adapter may be made of plastic, and others such as the frame, insert, socket and support may be made of metal, etc.

However, because of the facility and economy of fabricating such parts of plastic, e.g. by conventional injection molding technique, etc., plastic parts are generally preferred, except in the case of an angle bracket support, especially one contemplating reception therein of a plug socket of the type in question, and/or utilzing a magnet for bracket mounting purposes.

As to specific dimensions (in inches) for the pertinent parts of the assembly, the socket may have a recess of 0.065 axial depth and 0.710 diameter, and 0.010 radial length arrester depressions, providing a 0.730 diameter between directly opposed depressions, and an orifice of 0.410 axial length, tapering from a 0.650 upper diameter at the recess inner edge to a 0.635 lower diameter at the lip containing bottom wall, with such bottom wall upwardly axially spaced 0.150 from the level of the bottom peripheral edge of, e.g. an open underside type, support having a 0.625 vertical thickness (cf. FIGS. 5–6).

In turn, the adapter may have (in inches) a rim of 0.060 axial thickness and 0.690 diameter, and 0.015 radial length stop projections, e.g. of 0.060 typical circumferential width, providing a 0.720 diameter between directly opposed projections, a bore of 0.580 axial length, and a 0.600 exterior wall diameter with a 0.100 axial length external detent upwardly and outwardly tapering to a 0.690 maximum diameter, with the bore containing a slot formation, e.g. having 0.500 diametrical length diagonal slots arranged below and in offset relation to a square entrance recess of 0.110 axial depth and 0.435 sides, such that the slots outwardly taper from a 0.100 radially outer end width to a 0.110 radially inner end width at the point where they are in central open communication with each other (cf. FIGS. 2–4). These adapter dimensions provide acceptably close tolerances for use with a socket of the above dimensions. Of course, the associated cruciform formation insert will have corresponding mating dimensions allowing for tolerances.

Thus, it is clear that the assembly components are relatively small in size, capable of fabrication within close dimensional tolerances, lending themselves to operation with minimum distortion in achieving locking and unlocking of the pertinent coacting parts, and generally light in weight. At the same time, they permit efficient incremental "click" interval rotation of the frame, insert and adapter with respect to the socket and its support, to achieve the basis purpose of the assembly, while also avoiding any otherwise adverse effects of accidentally twisting the frame, due to the very nature of the rotational arrangement provided according to the present invention.

It will be apparent to those skilled in the art that the signholder or frame referred to herein is intended to embrace all types of merchandising items in which indicia may be displayed, regardless of the particular form or shape thereof, so long as the item is connected or connectable to an insert as contemplated herein.

Also, the terms "vertical" and "horizonal" are used herein for convenience in orienting the positional relationships to one another of the pertinent parts of the assembly construction of the present invention, but are intended to apply to all spatial relationship angular positions, whether strictly horizontal, vertical or otherwise, since it is clear that signholder, frame, and the like type merchandising indicia displaying items may be positioned in any given spatial orientation, depending on the effect sought to be achieved thereby.

It will be appreciated that the foregoing specification and accompanying drawings are set forth by way of illustration and not limitation of the present invention, and that various modifications and changes may be made therein without departing from the spirit and scope of the present invention which is to be limited solely by the scope of the appended claims.

What is claimed is:

1. Rotational signholder support assembly, which comprises a rotatable male tubular adapter and a stationary mating female mounting socket for rotatably coaxially receiving the adapter in a selective number of rotatably changeable individual relative angular rotational alignment positions, the adapter including an annular rim having stop means, and a shank connected to the rim and having an interior bore adapted for receiving a mating male attachment insert which in turn is adapted for connection thereto of an overlying signholder, and further having a circular exterior wall, and the socket including an annular recess arranged for receiving the rim and having arrester means releasably interlockable lockable with the stop means at each of said positions, and a circular interior orifice communicating with the recess and arranged for receiving the circular wall, the stop means and arrester means being arranged such that when the adapter is in the socket at a selected said position, the stop means releasably operatively interlock with the arrester means to maintain the adapter releasably at that position, and when the adapter is rotated to a different position the stop means operatively unlock from the arrester means and operatively reinterlock with the arrester means at the different position.

2. Assembly of claim 1 wherein the stop means includes a number of circumferentially equally spaced apart stops in the form of resiliently deformable radial projections corresponding to the number and angular rotational alignment of said positions, and the arrester means includes counterpart circumferentially equally spaced apart arresters in the form of radial depressions of number and angular rotational alignment corresponding to the stops for individually respectively releasably receiving and retaining the stops at each said position, such that when the adapter is in the socket at a selected said position, each stop releasably interlocks with the adjacent arrester in rotational alignment therewith to maintain the adapter releasably at that position, and when the adapter is rotated to a different position the stops unlock from the original arresters and reinterlock with those at the different position.

3. Assembly of claim 1 wherein the circular wall contains an edge formation and the circular orifice contains a counterpart abutment releasably interengageable with the edge formation to maintain the adapter in rotatable interconnection with the socket when received therein.

4. Assembly of claim 3 wherein the edge formation is a resilient detent and the abutment is a detent engaging lip.

5. Assembly of claim 1 wherein the adapter is made of plastic.

6. Assembly of claim 1 wherein the socket is made of plastic.

7. Assembly of claim 1 wherein the socket is in the form of a plug non-rotatably insertable in a hollow formation of a stationary support.

8. Assembly of claim 1 wherein the shank bore has a connection formation for receiving a mating connection formation of a male attachment insert.

9. Assembly of claim 8 wherein the connection formation is of cruciform shape.

10. Assembly of claim 8 including a male attachment insert having a connection formation mating with the connection formation of the shank bore, the insert being adapted for connection thereto of an overlying signholder.

11. Assembly of claim 10 wherein the insert is made of plastic.

12. Assembly of claim 10 wherein the corresponding connection formations are of cruciform shape.

13. Assembly of claim 10 the insert is connected to an overlying signholder.

14. Assembly of claim 1 wherein the socket is nonrotatably connected to a stationary support.

* * * * *

UNITED STATES PATENT AND TRADEMARK OFFICE

CERTIFICATE OF CORRECTION

PATENT NO. : 4,776,116

DATED : October 11, 1988

INVENTOR(S) : Bernard Shuman

It is certified that error appears in the above-identified patent and that said Letters Patent is hereby corrected as shown below:

Claim 1, Col. 11, line 11, after "interlockable" delete "lockable".

Signed and Sealed this

Twenty-first Day of February, 1989

*Attest:*

DONALD J. QUIGG

*Attesting Officer*

*Commissioner of Patents and Trademarks*